United States Patent [19]

Yataki et al.

[11] 4,445,649

[45] May 1, 1984

[54] ADJUSTABLE REEL

[75] Inventors: Masamichi Yataki, Ottawa; Glen W. D. Dack, Almonte; Paul S. Ertl, Nepean, all of Canada

[73] Assignee: Northern Telecom Limited, Montreal, Canada

[21] Appl. No.: 274,470

[22] Filed: Jun. 17, 1981

[51] Int. Cl.[3] ..... B65H 75/14; B65H 75/24

[52] U.S. Cl. ..... 242/118.2; 242/110; 242/118.4; 242/118.7

[58] Field of Search ..... 242/118.1, 118.11, 118.2, 242/159, 71.8, 68.2, 72 R, 72 B, 110, 68.5, 115, 118.3, 118.32, 118.4, 118.7, 118.8; 68/189, 198, 199

[56] References Cited

U.S. PATENT DOCUMENTS

| | | | |
|---|---|---|---|
| 1,114,784 | 10/1914 | McDevitt | 242/118.2 X |
| 1,719,730 | 7/1929 | Schoenfeld | 242/118.11 X |
| 3,310,252 | 3/1967 | Ewing | 242/68.2 |
| 3,550,872 | 12/1970 | Porterfield | 242/71.8 X |
| 3,593,938 | 7/1971 | Watt | 242/118.2 X |
| 3,777,515 | 12/1973 | Hattori | 68/198 |
| 4,219,274 | 8/1980 | Dabby et al. | 242/115 X |

FOREIGN PATENT DOCUMENTS

| | | | |
|---|---|---|---|
| 332112 | 8/1958 | Fed. Rep. of Germany | 242/118.11 |
| 1258777 | 3/1961 | France | 242/118.2 |
| 532825 | 9/1955 | Italy | 242/118.11 |
| 533135 | 9/1955 | Italy | 242/118.2 |
| 1233735 | 5/1971 | United Kingdom | 242/118.11 |

*Primary Examiner*—Stuart S. Levy
*Assistant Examiner*—Scott J. Haugland
*Attorney, Agent, or Firm*—Stuart L. Wilkinson

[57] ABSTRACT

Optical fiber wound onto a take-up reel after production is invariably tensioned such that results of characterization tests performed on the wound fiber are markedly different from such results obtained when the fiber is untensioned. Doubly winding the fiber to minimize tension is a laborious procedure. The invention covers a reel which has an adjustable hub circumference. Adjustment can be made with the fiber wound onto the hub so allowing rapid characterization of the fiber prior to restoring the fiber and the hub to their normal storage positions for fiber shipment.

7 Claims, 4 Drawing Figures

ADJUSTABLE REEL

This invention relates to a contractable reel for storing optical fiber.

Optical fiber when wound on a reel during production is invariably too tightly packed to allow measurement of fiber characteristics such as attenuation and pulse dispersion. Even if winding tension is reduced to 20 or 30 gf, the fiber, especially if it has a resilient coating, packs tightly and tension is inevitably introduced.

In the past, in order to place the fiber in an untensioned condition to permit characterization tests to be performed, we have pulled the fiber from the production unit to a take-up reel onto which the fiber is wound. Before winding however, one or more cylindrical rods are held at the hub circumference parallel with the hub axis and the fiber is wound around the hub and rod combination. Then, when characterization tests are to be performed, the rods are simply pulled longitudinally from under the fiber to leave it untensioned. Following completion of tests, this has necessitated laborious rewinding of the fiber to restore it to its tensioned state before it can be shipped.

An optical fiber storage reel is now proposed which has an adjustable hub circumference. In use, fiber is wound onto the reel in a storage condition in which it has a relatively large circumference. The circumference is then reduced to lower tension in the wound fiber and to permit accurate characterization of the fiber to be carried out.

According to one aspect of the invention the reel hub has an outer cylindrical wall comprising a plurality of arcuate sections at least one of the arcuate sections being hingedly mounted between spaced flanges of the reel and being rotatable about the hinge mounting to move a part thereof radially inward.

According to another aspect of the invention, a slot extends from the circumference of the reel partially into the spaced flanges and hub, the material of the reel being deformable to open or close the slot and thereby change the hub circumference.

According to a third aspect of the invention, a reel having spaced flanges and an intermediate hub is divided into at least two parts, the reel having resilient means interconnecting the parts and deformable to permit relative movement of the parts to change the hub circumference.

Embodiments of the invention will now be described by way of example with reference to the accompanying drawings in which.

Figure 1:
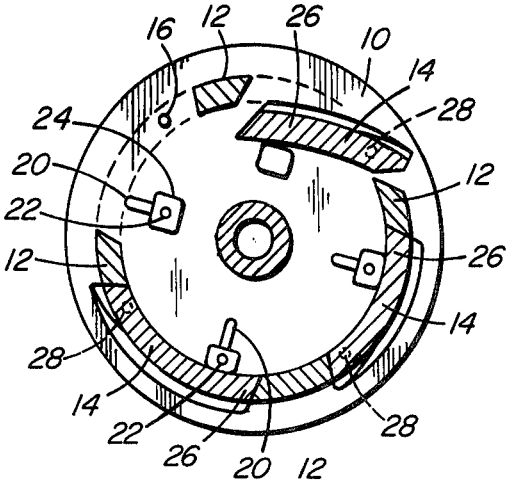
FIG. 1 is a vertical section through one type of reel according to the invention, the reel illustrated having one part removed.
Figure 2:
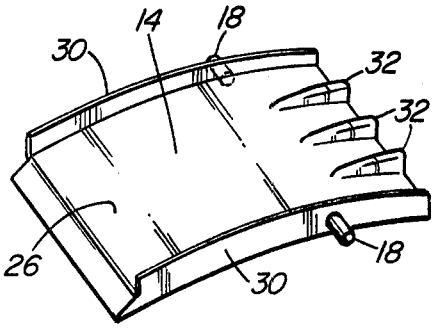
FIG. 2 is a perspective view of the part removed from FIG. 1.

Referring in detail to FIGS. 1 and 2, there is shown a vertical section through a reel in a plane perpendicular to the reel axis. The Figure shows one of a pair of flanges 10 between which extend a hollow composite hub. The hub consists of arcuate sections 12 integral with the flanges 10 and arcuate sections 14 which are hinge mounted between the flanges. The flanges have holes 16 in which mounting pips 18 projecting from the sides of sections 14 are rotatably housed. Formed in each flange 10 are slot apertures 20 along which screw clamps 22 can be moved and clamped to the flange to fix their radial positions. An anchor plate 24 forming part of each clamp projects inwardly from the flange inner surface and underlies one end 26 of an associated hinge section 14 so limiting pivotal movement of the section about pivot point 28.

Referring to FIG. 1, the hinged section 14 has integral boundary walls 30 which, when the section is in position, butt against the inner surfaces of the flanges. Projecting from the top surface of the section 14 on the far side of the pivot point 28 from the retractable end part 26 are integral fins 32. When an arcuate section 14 is pivotted to retract end part 26, the fins 32 project up above the normal contour of the hub circumference whereas, when the end part 26 is not retracted, the fins 32 are located partly below the hub circumference. Edges of both sections 12 and 14 are bevelled to ensure that circumferentially adjacent sections accurately seat against one another in the unretracted position. As shown in FIG. 1, one of the hinged sections 14 is removed, another is retracted and the remaining two are unretracted. When fiber is initially wound onto the reel, the clamps 22 are fixed in a position which keeps the retractable end parts 26 in a radially outward position. Then, when characterization tests need to be performed on the fiber in an untensioned state, the clamps are moved radially inward. Consequently, the retractable parts are pressed in by the fiber, fiber tension being simultaneously alleviated. Movement of the arcuate section 14 about their pivot points 28 brings the fins 32 above the normal contour of the hub outer surface. The fins 32 tend to keep the now untensioned fibers from becoming tangled. Boundary walls 30 keep the fibers from slipping down between the sections 14 and the flanges 10 as they are especially prone to do during movement of the hinged sections 14. The various parts of the reel can be molded in plastics.

Figure 3:
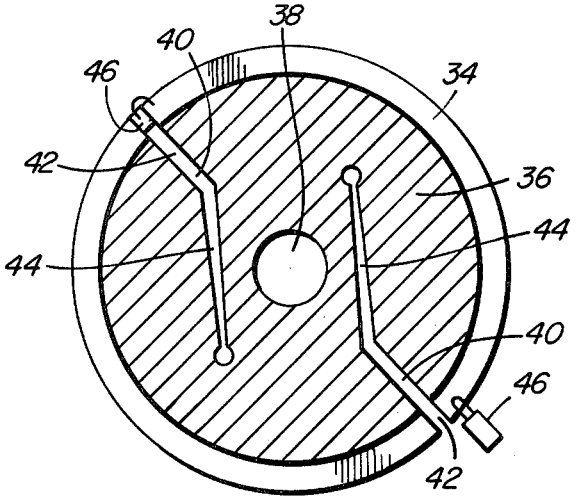
FIG. 3 is a vertical section through another type of reel.

Referring now to FIG. 3, an alternative design of reel is illustrated, again in vertical section perpendicular to the reel axis. The reel is a one piece foamed polyethylene molding having flanges 34 and a solid hub 36 with a central bore 38. Extending into the reel are a pair of tapered slots 40. The slots have opposed outer sections 42 extending perpendicularly to the hub surface, the outer sections being aligned with each other. Inner slots sections 44 extend parallel to each other on opposite sides of the reel axis. The reel is molded in flexible plastics. In operation, when winding optical fiber onto the reel, wedges 46 anchored to the flanges 34 are wedged into the outer slot sections 42 to keep the slots open. Then, after winding is finished, to reduce tension the wedges are removed and, if need be, pressure is applied to the reels to close the slots and so alleviate tension within the fibers. Although in the embodiment illustrated in FIG. 3 the slots when closed represent a stressed condition of the reel, the reel could alternatively be made with thin cuts in place of the slots 40. The cuts, when forced open to increase the hub circumference then represents the stressed condition of the reel material. In both cases stress can be reduced by having a small hole at the inner ends of the slots or cuts.

Figure 4:
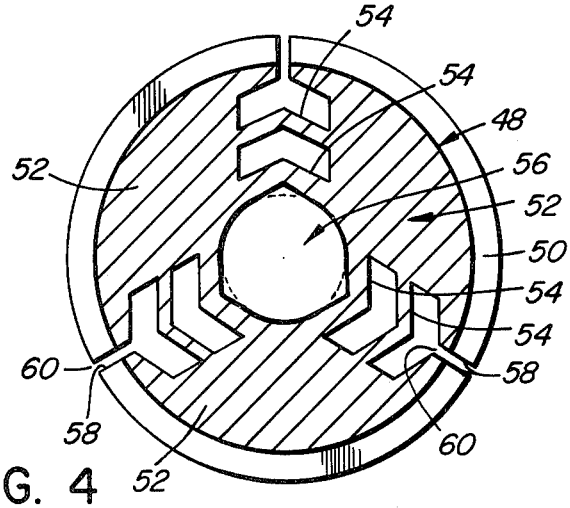
FIG. 4 is a vertical section through yet another type of reel.

Referring in detail to FIG. 4, an alternative reel is illustrated, again as a vertical section in a plane perpendicular to the reel central axis. The reel has a hub 48 and side flanges 50 and is divided into three segments 52 which are joined by thin chevron-shaped web portions 54. The web portions can be straightened to increase the circumference of the hub 48 by inserting an oversized shaft into a bore 56 centered on the reel axis. Again, fiber is wound onto the reel in its expanded hub condition. When characterization of the fiber is to take place, a correctly-sized shaft is substituted for the oversized shaft and contact surfaces 58 normally separated by a gap 60 butt together with associated reduction in hub circumference and therefore fiber tension. The reel illustrated can be produced as a one-piece flexible foam polystyrene molding. A tapered shaft and corresponding tapered reel bore can be used to adjust the hub circumference, and therefore fiber tension, simply by axial movement of the shaft.

Although preferred as a single molding, the webs 54 can be replaced in an alternative embodiment by resilient interconnection pieces. Although the reel illustrated in FIG. 4 is in its stressed condition when the hub circumference is enlarged, in an alternative embodiment (not shown) the hub circumference is stressed when the hub circumference is at its lower value. With such an embodiment pressure must be applied at the reel perimeter to reduce the circumference of the hub. This is inconvenient for the three segment reel illustrated but could be simply achieved in a reel consisting of two semicircular reel parts having resilient interconnection pieces.

What is claimed is:

1. A reel comprising a one-piece molding having a cylindrical barrel portion extending between two flanges, the barrel portion having an outer wrapping surface, each flange extending in a plane perpendicular to an axis of the reel, the reel having at least one slot extending throughout its length, the slot being of uniform cross section through the length of the reel and tapering uniformly from respective flange peripheries to a position radially within the wrapping surface, and wherein the slot has radially outward part extending substantially radially and a second part extending from said radially outward part to a position radially inward of the wrapping surface, the radially inward part extending non-radially, the slot normally open but closeable on pressing parts of the reel on opposite sides of the slot together whereby to reduce the circumference of the barrel portion.

2. A reel comprising a one-piece molding having a cylindrical barrel portion extending between two flanges, the barrel portion having an outer wrapping surface, each flange extending in a plane perpendicular to an axis of the reel, the reel having at least one slot extending throughout its length, the slot being of uniform cross section through the length of the reel and tapering uniformly from respective flange peripheries to a position radially within the wrapping surface, and wherein the slot has a radially outward part extending substantially radially and a second part extending from said radially outward part to a position radially inward of the wrapping surface, the radially inward part extending non-radially, the slot normally closed but openable on forcing parts of the reel on each side of the slot apart whereby to increase the circumference of the barrel portion.

3. A reel as claimed in claim 1 or 2, the reel having a pair of such slots, the slots having radially outward sections aligned with one another and extending perpendicularly to the circumference of the barrel portion and inner sections parallel to one another and on opposed sides of the reel axis.

4. A reel as claimed in claim 1 or 2 further including wedges dimensioned to friction fit within the slot at the periphery of each flange whereby to keep the reel in an expanded condition.

5. A reel as claimed in claim 1 or 2, the reel being a one-piece molding of polystyrene.

6. A reel as claimed in claim 1 or 2 in which the parts of the reel on opposite sides of the slot which are pressed together to close the slot have positive abutment surfaces.

7. A reel comprising a one-piece molding having a cylindrical barrel portion extending between two flanges, the barrel portion having an outer wrapping surface, each flange extending in a plane perpendicular to an axis of the reel, the reel having a plurality of slots extending throughout its length and extending from respective points at the periphery of each flange across both a part of the flange and the barrel portion, the slots having radially outward sections aligned with one another and extending perpendicularly to the hub circumference and inner sections parallel to one another and on opposed sides of the reel axis, the respective slots closeable on pressing parts of the reel on opposite sides of the slots together whereby to reduce the hub circumference.

* * * * *